United States Patent [19]

Farnhill et al.

[11] 4,372,109

[45] Feb. 8, 1983

[54] ROLLER FOR FRICTION SPINNING APPARATUS

[76] Inventors: William M. Farnhill, 335 Colne Rd., Burnley, Lancashire; Alan Parker, 7 Darvel Close, Breightmet, Bolton, Lancashire, both of England

[21] Appl. No.: 252,968

[22] Filed: Apr. 10, 1981

[30] Foreign Application Priority Data

Apr. 19, 1980 [GB] United Kingdom ..... 8012959

[51] Int. Cl.[3] ..... D01H 7/882

[52] U.S. Cl. ..... 57/401; 57/334

[58] Field of Search ..... 57/58.89–58.95, 57/334, 335, 401

[56] References Cited

U.S. PATENT DOCUMENTS 4,168,601 9/1979 Didek et al. ..... 57/58.89

4,281,507 4/1981 Didek et al. ..... 57/58.89

*Primary Examiner*—John Petrakes

*Attorney, Agent, or Firm*—Donald H. Feldman

[57] ABSTRACT

A roller for a friction spinning apparatus comprises a hollow perforated base member of aluminium or similar material, with a chrome dioxide plasma coating at most 0.004 inch. The perforations are at most 0.03 inch in diameter and provide a ratio of hole to total area of at least 25%. The thickness of the base member is at most 0.125 inch.

8 Claims, 1 Drawing Figure

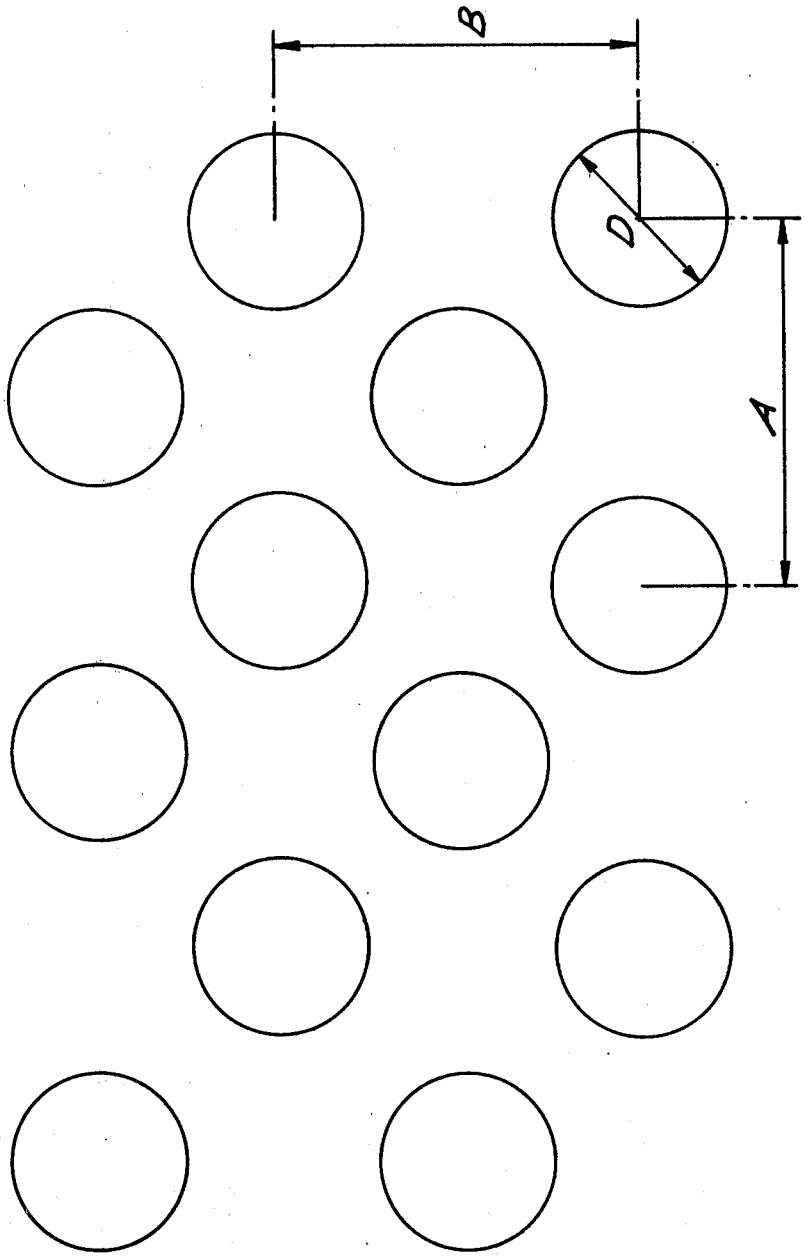
B
D
A

ROLLER FOR FRICTION SPINNING APPARATUS

FIELD OF THE INVENTION

This invention relates to rollers for firction spinning apparatus.

BACKGROUND OF THE INVENTION

There are now several patent specifications showing different forms of friction spinning apparatus in which fibres are spun into a yarn by being deposited on and twisted by a moving perforated surface. The surface generally is formed by a hollow perforated roller or base member. However, the only specification which gives details of the structure of the roller and its surface is U.S. Pat. No. 4,281,507 of Vyzkumny Ustav Bavlnarsky. This shows various formations of perforations or holes in the surface and mentions that the base member can be coated, with several possibilities for coatings being given. Other patents show the roller and its surface only schematically and none has yet formulated the requirements for a perforated surface of this kind.

SUMMARY OF THE INVENTION

The present invention therefore has as its object a perforated roller providing a surface for an apparatus of the above kind, the roller exhibiting the optimum characteristics for successful spinning.

The invention is therefore characterized in that the thickness of the base member is at most 0.125 inches (3.2 mm) and the percentage of hole area to total surface area of the base member, measuring the hole area at the smallest cross-section of each hole, is at least 25%.

DESCRIPTION OF THE PREFERRED EMBODIMENT

The invention will become more apparent from the following description thereof in conjunction with the accompanying drawing showing the arrangement of holes in greatly enlarged form.

In our Published U.S. Pat. No. 4,315,398 is disclosed an apparatus of the above kind including only one perforated roller. The roller of the present invention is specifically designed for use in this apparatus but could also be used in other apparatus of this kind.

The roller comprises a cylindrical shell formed of a readily worked metal or other strong support material. Preferably the shell is of aluminium as this is very easy to work and provides the necessary strength, but mild steel, brass or bronze can also be used.

The thickness of the shell is kept to a minimum to provide the necessary strength to support the structure. A thickness of ⅛ inch (3.2 mm) is too great in that it unduly restricts the passage of air through perforations. A thickness of 1/16th inch (1.6 mm) is fully satisfactory.

The strength of the roller which is necessary is that sufficient to avoid inadvertent deformation during handling since forces during spinning are relatively small.

The holes in the roller must provide the minimum resistance to the passage of air through the surface of the roller while preventing the passage of fibres or the trapping of any part of a fibre. In the preferred embodiment the holes are of 0.024 inch diameter (0.6 mm), but they may be as large as 0.030 inch (0.75 mm) and as small as 0.020 inch (0.5 mm). The holes are drilled mechanically with cylindrical shape as by a conventional drill.

The required number of holes is the maximum which can be provided consistent with leaving sufficient material to provide the necessary strength. The maximum number of holes can be provided if, as shown in the drawing, adjacent otherwise parallel rows of drilled holes alternate such that a line joining the centers of adjacent holes in the same row and a line joining the centers of adjacent holes in two adjoining rows intersect to form an approximately 45° angle with one another. With holes of 0.024 inch diameter and a thickness of aluminium shell of 0.062 inch the minimum spacing of centres (Dimension B) is of the order of 0.046 inch in each longitudinal row with a spacing of 0.023 inch (half of Dimension A) from a centre in one row to the adjacent centre in the next circumferential row. This gives a total of 913 holes per square inch and 41% hole area. To obtain satisfactory air flow conditions a hole area of at least 25% is desirable and preferably greater than 30%. 30% hole area can be achieved using 0.020 inch holes at the same centre spacing as above. The above percentages of hole area are calculated by measuring the area of each hole at its smallest cross-section. In this case the holes are cylindrical and hence the cross-section is constant.

Examples with reference to the drawing, wherein "A" designates the distance between the centers of adjacent holes in a row thereof circumferential the perforated roller, and "B" designates the distance between the centers of adjacent holes in a row thereof parallel the roll axis, and "D" designates the diameter of the circular hole, of suitable hole configuration are set out in the following table:

| A inch | B inch | D inch | Holes/sq.in | % Hole Area. |
|---|---|---|---|---|
| 0.036 | 0.056 | 0.020 | 1,000 | 31.4 |
| 0.048 | 0.046 | 0.024 | 913 | 41.3 |
| 0.036 | 0.056 | 0.024 | 1,000 | 45.2 |

Thus in a roller of 40 mm (1.57 inches) diameter there are preferably 88 holes per circumference arranged in 201 rows.

In order to provide a surface having suitable spinning characteristics and co-efficient of friction relative to fibres, and is resistant to wear the aluminium shell is coated with a ceramic material, preferably chromedioxide ($Cr_3O_2$) by a plasma coating method. Such a coating can be provided by Union Carbide under their classification LC4. The thickness of coating is preferably at most 0.004 inch and preferably of the order of 0.001 to 0.002 inch. The coating is allowed to enter the holes to give a rounded edge to the mouth of the hole but is thin to prevent undue restriction of the holes by the coating. Other ceramic coatings by plasma spray method or discharge gun method are possible.

We claim:

1. A roller for a friction spinning apparatus comprising a hollow perforated base member having on its outer surface a coating, characterized in that the thickness of the base member is at most 0.125 inches (3.2 mm), the percentage of hole area to total surface area of the base member, measuring the hole area as the summation of those at the smallest cross-section of each hole, is at least 25% and the diameter of each of the holes is at most 0.03 inches (0.75 mm).

2. A roller as claimed in claim 1, wherein the thickness is of the order of 0.063 inches (1.6 mm).

3. A roller as claimed in claim 1, wherein the hole area is at least 30%.

4. A roller as claimed in claim 1, wherein the diameter of the holes is of the order of 0.024 inches (0.6 mm).

5. A roller as claimed in claim 1, wherein the holes are of cylindrical shape.

6. A roller as claimed in claim 1, wherein the thickness of the coating is at most 0.004 inch (0.1 mm).

7. A roller as claimed in claim 1, wherein the base member is coated with a ceramic material.

8. A roller as claimed in claim 7, wherein the ceramic coating is a plasma coated chrome dioxide.

* * * * *